United States Patent [19]

Fischer

[11] Patent Number: 4,781,395

[45] Date of Patent: Nov. 1, 1988

[54] SKI

[75] Inventor: Josef Fischer, Ried im Innkreis, Austria

[73] Assignee: Fischer Gesellschaft M.B.H., Ried im Innkreis, Austria

[21] Appl. No.: 923,417

[22] Filed: Oct. 27, 1986

[30] Foreign Application Priority Data

Oct. 28, 1985 [AT] Austria ..... 3105/85

[51] Int. Cl.[4] ..... A63C 5/12

[52] U.S. Cl. ..... 280/610

[58] Field of Search ..... 280/601, 608, 609, 610

[56] References Cited

U.S. PATENT DOCUMENTS

| | | | |
|---|---|---|---|
| 3,276,784 | 10/1966 | Anderson, Jr. | 280/610 |
| 3,970,324 | 7/1976 | Howat | 280/610 |
| 4,115,506 | 9/1978 | Shima | 264/250 |
| 4,250,585 | 2/1981 | Theriault et al. | 441/70 |
| 4,455,037 | 6/1984 | Pilpel et al. | 280/610 |
| 4,530,871 | 7/1985 | You | 280/610 |

FOREIGN PATENT DOCUMENTS

| | | |
|---|---|---|
| 274626 | 9/1969 | Austria . |
| 330624 | 7/1976 | Austria . |
| 1578965 | 12/1970 | Fed. Rep. of Germany . |
| 1703078 | 12/1971 | Fed. Rep. of Germany . |
| 2151944 | 4/1972 | Fed. Rep. of Germany . |
| 84816 | 12/1965 | France . |
| 1453516 | 9/1966 | France . |
| 1473256 | 3/1967 | France . |
| 2097849 | 3/1972 | France . |

*Primary Examiner*—John J. Love
*Assistant Examiner*—Richard Lamby
*Attorney, Agent, or Firm*—Fleit, Jacobson, Cohn & Price

[57] ABSTRACT

A ski comprising a ski body component (1) and a trough (2). The ski body component is a prefabricated component which is formed from a core (3), steel edges (6 and 6', respectively), a running surface coating (7) and possible intermediate layers. To produce the ski, the prefabricated ski body component (1) is introduced into a trough-shaped mould (9), a space being left free for the production of the trough, whereupon the free space is filled with plastics material, preferably by RTM method. The sole FIGURE serves and the FIGURE for the Abstract.

8 Claims, 1 Drawing Sheet

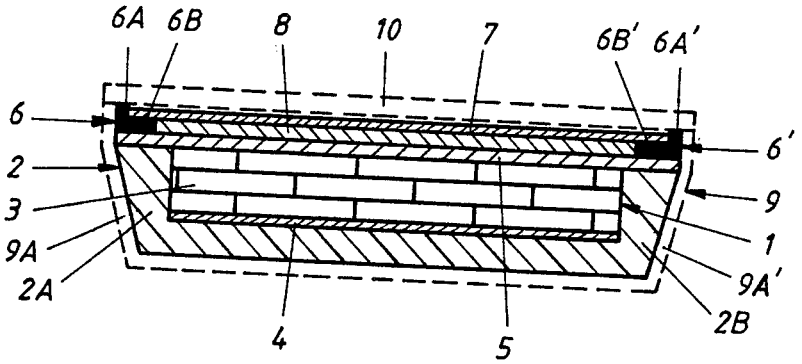
6A
6B
8
10
7
6B'
6A'
6
6'
2
9
3
1
9A
9A'
2A
2B
4
5

SKI

The invention relates to a ski having a core, a running surface coating and lateral running edges, the core being covered with a layer of plastics material on its upper surface and laterally at least over a portion of the depth of the ski, possibly by the provision of an intermediate layer.

A further subject-matter of the invention resides in a method for the production of the ski, according to which method the component parts of the ski are introduced into a mould which, after being closed, is filled with plastics material.

Finally, a device for accomplishing the method is also a subjectmatter of the invention.

The invention seeks to provide a ski which can be produced by simple means and has an extremely good resistance to wear, the desired external dimensions also being able to be maintained exactly.

To achieve this object with a ski of the above-mentioned type, it is proposed, according to the invention, that the layer of plastics material forms a one-piece trough which has a substantially U-shaped cross-section and is formed from hard plastics material, preferably from coating material based on PUR.

It is also a subject-matter of the invention that the core, possibly by the provision of an intermediate layer, forms a prefabricated ski body component with the running surface coating, the lateral running edges and possibly an upper intermediate layer.

A method of producing this ski is proposed, whereby, according to the invention, the prefabricated ski body component is introduced into a trough-shaped mould, a space being left free for the production of the trough, whereupon the free space is filled with plastics material, preferably by an RIM method.

The space in the trough-shaped mould is preferably evacuated either before or during the introduction of the plastics material.

The trough-shaped mould used for accomplishing the method has at least one support means for supporting the inserted ski body component along each of its two narrow-sided, longitudinally extending lateral walls.

The invention is explained more fully with reference to the drawing which is a cross-sectional view of one embodiment of the ski according to the invention, this view showing the mould used for producing the ski.

The ski shown in the drawing includes a ski body component 1 and a trough 2. The ski body component 1 is a prefabricated component which comprises a core 3, an upper cover layer 4 and a lower cover layer 5—both layers formed from metal, preferably aluminium—two L-shaped steel edges 6 and 6' extending along the running surface, a running surface coating 7 and an intermediate layer 8. The structural members of the ski body component 1 are joined together by glue or by a similar means, the lower cover layer 5 protruding beyond each side of the core 3 by an amount corresponding to the desired thickness of the lower ends of the sides 2A and 2B of the trough 2. The running surface 7, which is preferably a coating of plastics material, fills the space between the vertical sides 6A and 6A' of the edges 6 and 6' in a known manner, whereas the space between the horizontal portions 6B and 6B' is filled by the intermediate layer 8 which is preferably formed from plastics material. In the present case, at least in the region of the layers abutting against the trough 2 the core 3 is formed from a material which produces a firm connection with the material of the trough 2.

To produce the ski, the ski body component 1 is introduced in an upright position into a trough-shaped mould 9 which is adapted to be closed by a lid 10. In this embodiment, the lateral walls 9A and 9A' extend downwardly, i.e. towards the upper surface of the ski, first of all in a straight line and then inclinedly to taper towards one another, so that the edge of the lower cover layer 5 of the ski body component 1 is supported on the edge of the transitional portion between the straight section and inclined section of the longitudinally-extending lateral walls 9A and 9A', and so that a space remains free for the production of the trough 2. After the trough-shaped mould has been closed, this free space is filled with plastics material by a RIM (Reaction Injection Moulding) method, whereby the trough 2 is produced which surrounds the core 3 and terminates flush with the lateral edges of the lower cover layer 5. This arrangement causes the plastics material to be adapted to all the uneven surface portions of the core 3 and of the cover layer 4, in as much as the latter is diverted from the core 3, and adapts the surface pointing into the trough 2 to the lower cover layer 3, so that such layers do not have to be treated prior to the ski body component 1 being introduced into the mould 9. When coating material based on PUR is used, it is advantageous to produce steel edges and the running surface, or at least those parts of the ski body component which form the outer surface thereof, from a material which does not adhere to the coating material, e.g. polyethylene or steel. The advantage of this is that, after the trough 2 has been produced, any coating material which has passed to the outer lateral surfaces of the steel edges 6 and 6' or onto the running surface coating 7 can easily be wiped away, with the result that there is no need for a tool to be used to clean the ski surface mechanically. The outer surface of the trough which is formed from coating material is completely smooth without being treated, it is wear-resistant and impact-proof, it does not chip and it maintains its exact dimensions. The ski, which can be produced therefore at minimum cost, comes fixed and ready from the trough-shaped mould without having to be polished or subsequently treated in any other manner.

It is self-evident that various structural and technical modifications can be made within the scope of the invention. Consequently, it is possible to alter the construction of the core in any desirable manner. In such an event, the only essential requirement is that the core produces a firm connection with the material of the trough at its surfaces which come into contact with the trough. For this purpose, blind bores may be provided in the surfaces in contact with the trough 2, or grooves may be provided in the core which taper inwardly and also extend through the loewr cover layer 5 so that a form-fitting connection is additionally produced. For the same purpose, instead of the core having a rectangular cross-section, the core 3 may be given a trapezoidal cross-section, or the lower cover layer 5 may protrude laterally beyond the core 3.

In addition, other possible means may be provided for supporting the prefabricated ski body component, so that, when the prefabricated ski body component is introduced, such means position the ski body component in the trough-shaped mould in such a manner that a free space is left for the production of the trough.

I claim:

1. A ski having a core, a lower cover layer on a bottom surface of the core, the lower cover layer having edge portions extending beyond the core, a running surface coating and lateral running edges beneath the lower cover layer, the core being covered with a one-piece layer of plastics material, having a substantially U-shaped cross section, said one-piece layer having a web covering an upper surface of the core and limbs covering the sides of the core, said limbs having bottom surfaces covering said edge portions of the lower cover layer over their entire extent beyond the core and the limbs further having outer surfaces which taper inwardly over their entire extent from said bottom surfaces to an upper surface of the web.

2. The ski is claimed in claim 1 wherein the U-shaped layer of plastics material is formed from coating material based on PUR.

3. The ski is claimed in claim 2 including an upper cover layer between the core and the web, and wherein the upper and lower cover layers are formed of a metal.

4. A ski is claimed in claim 3 wherein the metal is aluminum.

5. A method of producing a ski which has a core, a lower cover layer on a bottom surface of the core, the lower cover layer having edge portions extending beyond the core, a running surface coating and lateral running edges beneath the lower cover layer, the core being covered with a one-piece layer of plastics material having a substantially U-shaped cross section, said one-piece layer having a web covering an upper surface of the core and limbs covering the sides of the core, said limbs having bottom surfaces covering said edge portions of the lower cover layer over their entire extend beyond the core and the limbs further having outer surfaces which tapers over their entire extent inwardly from said bottom surfaces to an upper surface of the web, the method comprising introducing a prefabricated ski body component including said core into a trough-shaped mould providing a space in the mould for the production of the one-piece cover, and filling the space with plastic material by a RIM method.

6. The method is claimed in claim 5 wherein the space is evacuated before the introduction of the plastic material.

7. A method is claimed in claim 5 wherin the space is evacuated during the introduction of the plastic material.

8. A method is claimed in claim 6 wherein the prefabricated component is introduced in an upright position into the mould and is supported in the mould on said edge portions of the lower cover layer.

* * * * *